US009511408B2

(12) United States Patent
Maggiolo

(10) Patent No.: US 9,511,408 B2
(45) Date of Patent: Dec. 6, 2016

(54) TUBE EXPANDING DRUM MACHINE

(71) Applicant: C.M.S. COSTRUZIONE MACCHINE SPECIALI S.R.L., Alonte (Vicenza) (IT)

(72) Inventor: Vinicio Maggiolo, Montagnana (IT)

(73) Assignee: C.M.S. COSTRUZIONE MACCHINE SPECIALI S.R.L., Alonte (Vicenza) (IT)

( * ) Notice: Subject to any disclaimer, the term of this patent is extended or adjusted under 35 U.S.C. 154(b) by 188 days.

(21) Appl. No.: 14/245,676

(22) Filed: Apr. 4, 2014

(65) Prior Publication Data

US 2014/0298874 A1 Oct. 9, 2014

(30) Foreign Application Priority Data

Apr. 5, 2013 (EP) ..... 13162560

(51) Int. Cl.

| | |
|---|---|
| ***B21D 37/18*** | (2006.01) |
| ***B21D 39/20*** | (2006.01) |
| ***B21D 53/08*** | (2006.01) |
| ***B21D 53/06*** | (2006.01) |
| ***B21D 41/02*** | (2006.01) |

(52) U.S. Cl.

CPC ..... *B21D 37/18* (2013.01); *B21D 39/20* (2013.01); *B21D 41/028* (2013.01); *B21D 53/06* (2013.01); *B21D 53/085* (2013.01)

(58) Field of Classification Search

CPC ..... B21D 37/18; B21D 39/20; B21D 53/02; B21D 53/06; B21D 53/085; B21D 41/026; B21D 41/028; B21D 43/10; B21D 43/105; B21D 43/11; B21D 43/12; B21D 43/13; B21D 43/14; B21D 43/145; B21D 43/16; B21D 43/18

USPC ..... 72/370.01, 370.05, 370.06, 370.07,72/370.08, 393, 449, 423, 289, 209, 208,72/31.06, 183

See application file for complete search history.

(56) References Cited

U.S. PATENT DOCUMENTS

| | | | | |
|---|---|---|---|---|
| 3,577,754 A * | 5/1971 | Calmes | B21B 17/04 | 72/209 |
| 3,646,798 A * | 3/1972 | Alcock | B21C 1/02 | 72/288 |
| 4,332,155 A * | 6/1982 | Pariseau | B21C 47/143 | 72/66 |
| 2010/0089111 A1* | 4/2010 | Shimoda | B21B 25/04 | 72/97 |

(Continued)

FOREIGN PATENT DOCUMENTS

| | | | |
|---|---|---|---|
| JP | 59197323 A * | 11/1984 | B21D 39/20 |
| WO | 2010/115427 | 10/2010 | |

*Primary Examiner* — Jimmy T Nguyen
*Assistant Examiner* — Gregory Swiatocha
(74) *Attorney, Agent, or Firm* — Tutunjian & Bitetto, P.C.

(57) ABSTRACT

A tube expanding drum machine, including a support frame, at least one drum rotatably supported in said frame, rotation means of the drum about its axis, a flexible pipe-expanding shaft wound on the drum and having a first end fixed to the drum, an expanding mandrel or a shaped ogive, connected to the second end of the flexible pipe-expanding shaft, suitable for widening the diameter of a pipe by winding or unwinding the flexible pipe-expanding shaft onto or from the drum inside the pipe itself. The machine includes a lubrication duct of the inner surface of the pipe during the pipe expansion foreseen inside the flexible shaft.

11 Claims, 7 Drawing Sheets

(56) References Cited

U.S. PATENT DOCUMENTS

| | | | | |
|---|---|---|---|---|
| 2012/0011916 | A1* | 1/2012 | Davidsen | B21D 39/20 72/449 |
| 2013/0186166 | A1* | 7/2013 | Warren | B21D 41/028 72/370.08 |

* cited by examiner

TUBE EXPANDING DRUM MACHINE

CROSS REFERENCE TO RELATED APPLICATIONS

This application claims the benefit of priority from European Patent Application No. 13192560.0 filed on Apr. 5, 2013, the contents of which are incorporated herein by reference.

TECHNICAL FIELD OF THE INVENTION

The present invention concerns a tube expanding drum machine.

More specifically, the present invention concerns a tube expanding drum machine in industrial contexts that is improved from the constructive and functional point of view.

DESCRIPTION OF RELATED ART

In the field of production of heat exchangers, but also in other industrial fields, machines for expanding pipes are used that carry out the expansion of pipes, according to per sé known ways of operating, for connection to the respective finned packs.

Some particular types of machines for expanding pipes are of the so-called drum type.

An example of such a machine is described in international patent application WO 2010/115427 A1.

The machine described in this document comprises a plurality of coaxial drums on each of which a flexible shaft is wound having a first end fixed to the surface of the drum, and a second free end to which an expanding mandrel is connected that, when actuated to expand through suitable means, is pulled from one end of a pipe to the other, expanding its diameter.

The pulling of the expanding mandrel is carried out through the winding of the cable around the drum, and thus by setting the drum in rotation about its axis, thanks to suitable motorisation.

This machine comprises a certain number of coaxial and arranged side-by-side drums, so as to be able to simultaneously carry out the expansion of a certain number of pipes, e.g. an entire row of pipes comprised in a heat exchanger, or a fraction of such a row.

In an entirely general way, one of the main problems connected to the pipe-expanding operation is the lubrication of the inner surface of the pipes.

Without this, indeed, the operation could not be completed due to the extremely high frictions, and the consequent overheating of the mechanical parts.

The quoted document WO 2010/115427 A1 says absolutely nothing about the problem of lubricating the inner surfaces of the pipes during pipe expansion.

Another of the main characteristics of the machine described in this document is the possibility of being able to actuate, at the user's discretion and in relation to the specific application requirements, just some of the drums foreseen in the machine, and not all of them at the same time.

In order to obtain this result, in the machine described in document WO 2010/115427 A1 a complex actuation system is used comprising a series of motors each associated with a respective drum.

In order to obtain a solution that is compact in terms of axial bulk—since the pipes to be expanded inside the same battery can also be very close together—the machine comprises, for each drum, a toothed crown coaxial with the drum and a series of pinions all meshed with the aforementioned crown, only one of which is connected to a respective motor, whereas the others are idle.

Obviously, this is a very expensive and mechanically complicated solution, both in terms of assembly and in terms of the actuation and control.

SUMMARY OF THE INVENTION

The technical task of the present invention is therefore to improve the state of the art.

In such a technical task, a purpose of the present invention is to devise a machine for expanding pipes with a drum that allows the efficient lubrication of the inner surfaces of the pipes during the expansion operation.

Another purpose of the present invention is to make a machine for expanding pipes with a drum that is simplified from the constructive and functional point of view.

This task and these purposes are accomplished by the tube expanding drum machine according to embodiments of the present invention.

The machine comprises a support frame, at least one drum rotatably supported in the frame, rotation means of the drum about its rotation axis, a flexible pipe-expanding shaft wound on the drum and having a first end fixed to the drum, and an expanding mandrel connected to the second end of the flexible pipe-expanding shaft, suitable for widening the diameter of a pipe by winding or unwinding the flexible pipe-expanding shaft onto or from the drum inside the pipe itself.

According to an aspect of the present invention, the machine comprises means for lubricating the inner surface of the pipe during expansion, foreseen inside the flexible shaft.

According to another aspect of the present invention, the machine comprises a selection group of the operative flexible pipe-expanding shafts, so as to be able to actuate the preselected drums, and thus the respective pipe-expanding shafts, with a single motor.

The dependent claims refer to preferred and advantageous embodiments of the invention.

BRIEF DESCRIPTION OF THE DRAWINGS

The characteristics of the invention will become clearer to any man skilled in the art from the following description and from the attached tables of drawings, given as a non-limiting example, in which.

DETAILED DESCRIPTION OF EMBODIMENTS OF THE INVENTION

Figure 1:
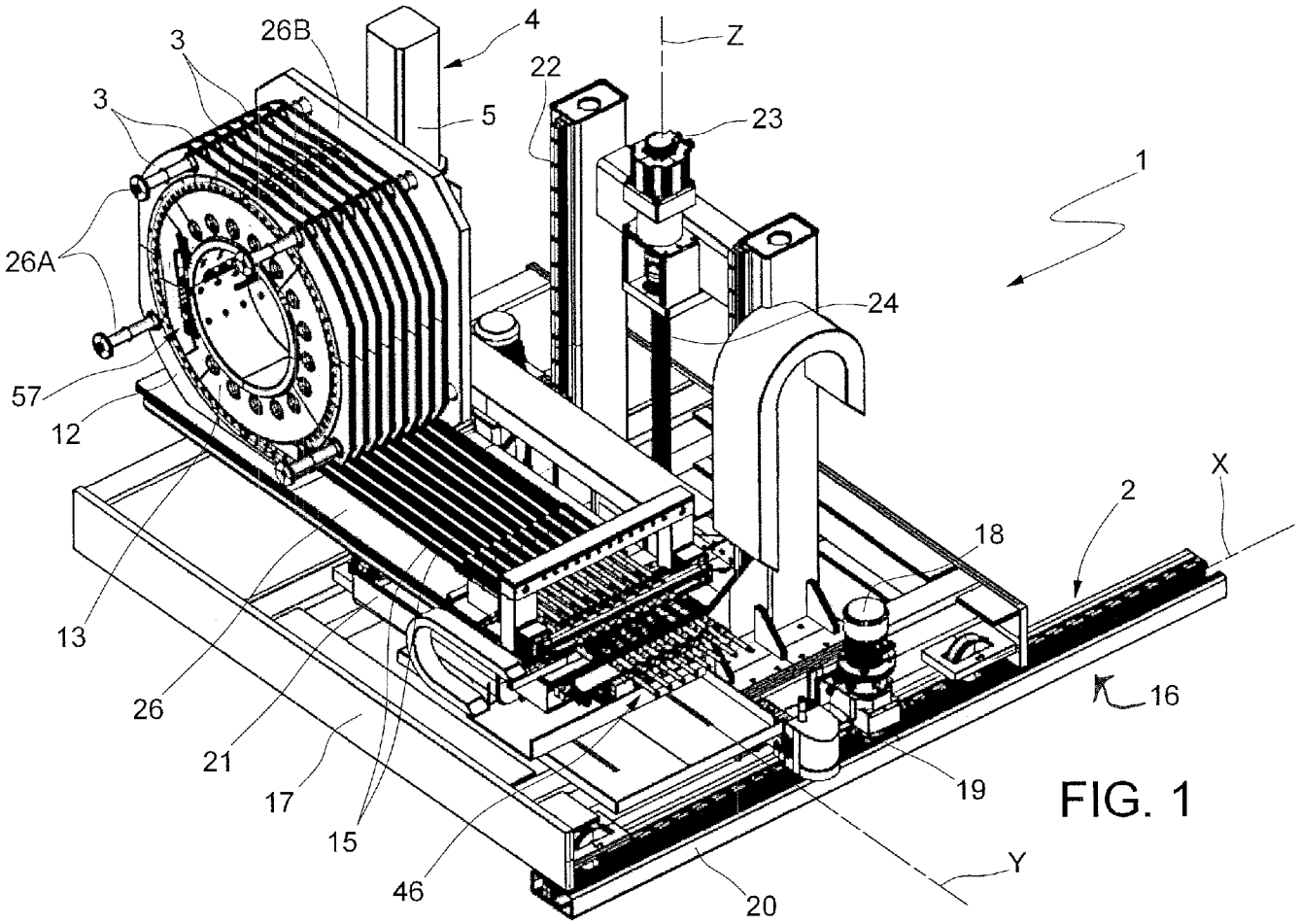
FIG. 1 is a perspective view of the machine according to the invention.

With reference to the attached FIG. 1, a tube expanding drum machine according to the present invention is wholly indicated with 1.

The machine according to the present invention is suitable for expanding pipes belonging, for example, to heat exchangers or other similar elements, of any shape and size and comprising any number of pipes, without any limitation.

The machine can however also be suitable for other applications in which it is necessary, for whatever reason, to widen the diameter of pipes or groups of pipes.

As will become clearer hereafter, the machine can be used for pipe expansion operations both under draft and under push.

The machine 1 comprises a support frame 2.

The machine 1 also comprises at least one drum 3, rotatably supported in the frame 2.

The machine also comprises rotation means, wholly indicated with 4, of the drum 3 about its axis.

The rotation means 4 comprise, in greater detail, a first gearmotor group 5.

The machine 1 comprises a flexible pipe-expanding shaft 6, wound on a mobile inner part 13 of the drum 3 and having a first end 7 fixed to the drum 3 itself.

An expanding mandrel 8 is connected to the second end 9 of the flexible pipe-expanding shaft 6.

The expanding mandrel 8 is suitable for expanding the diameter of a pipe 10 thanks to the pulling action exerted by the flexible pipe-expanding shaft 6, as will become clearer hereafter.

According to an aspect of the present invention, the machine 1 comprises automatic lubrication means, wholly indicated with 11, of the inner surface of the pipe 10 during pipe expansion.

The automatic lubrication means 11 are advantageously foreseen inside the flexible pipe-expanding shaft 6.

In the present embodiment, the machine comprises a plurality of drums 3, so as to carry out the expansion of a plurality of pipes 10 arranged side-by-side with parallel axes.

The drums 3 are supported coaxial and side-by-side on the frame 2, as described hereafter.

In particular, all of the drums 3 are actuated through a single gearmotor group 5.

In other embodiments that have not been represented, however, the machine can comprise a single drum 3 with a single flexible pipe-expanding shaft 6.

In the present embodiment, there can be any number of drums 3, in relation to the specific application requirements.

Each drum 3 comprises a fixed outer part 12 and the aforementioned mobile inner part 13.

Between the outer part 12 and the inner part 13 bearings 14 are mounted, along a certain rolling circumference.

Outside of the drum 3 there is a bearing guide 15 for the flexible pipe-expanding shaft 6.

In this way, the flexible pipe-expanding shaft 6 is always kept coaxial with the axis of the pipe 10 to be expanded.

The frame 2 of the machine 1 comprises floor guides 16 mounted perpendicular to the axis of the pipes 10.

The frame 2 also comprises a carriage 17, with which the drums 3 are associated.

The carriage 17 is thus mobile in a first horizontal direction X, perpendicular with respect to the axis of the pipes 10.

In greater detail, the carriage 17 is actuated through a second gearmotor group 18 fixed to the carriage 17 itself.

The second gearmotor group 18 comprises a gear wheel 19 mounted on its output axis and meshing on a rack 20 associated with one of the floor guides 16.

The frame 2 also comprises a bracket structure 21, with which the drums 3 are also associated.

More specifically, the bracket structure 21 is able to slide in a second vertical direction Z, along vertical guides 22 foreseen in the carriage 17.

The bracket structure 21 is actuated by a third gearmotor group 23, associated with the vertical guides 22.

The third gearmotor group 23 is, in particular, associated with a worm screw 24, with which a nut 25 is coupled, fixed to the bracket structure 21.

The frame 2 of the machine 1 also comprises a slide 26, on which the drums 3 are directly mounted.

The slide 26 is able to slide along a third horizontal direction Y—parallel to the axis of the pipes 10 to be expanded—along horizontal guides 27 foreseen in the bracket structure 21.

Figure 10:
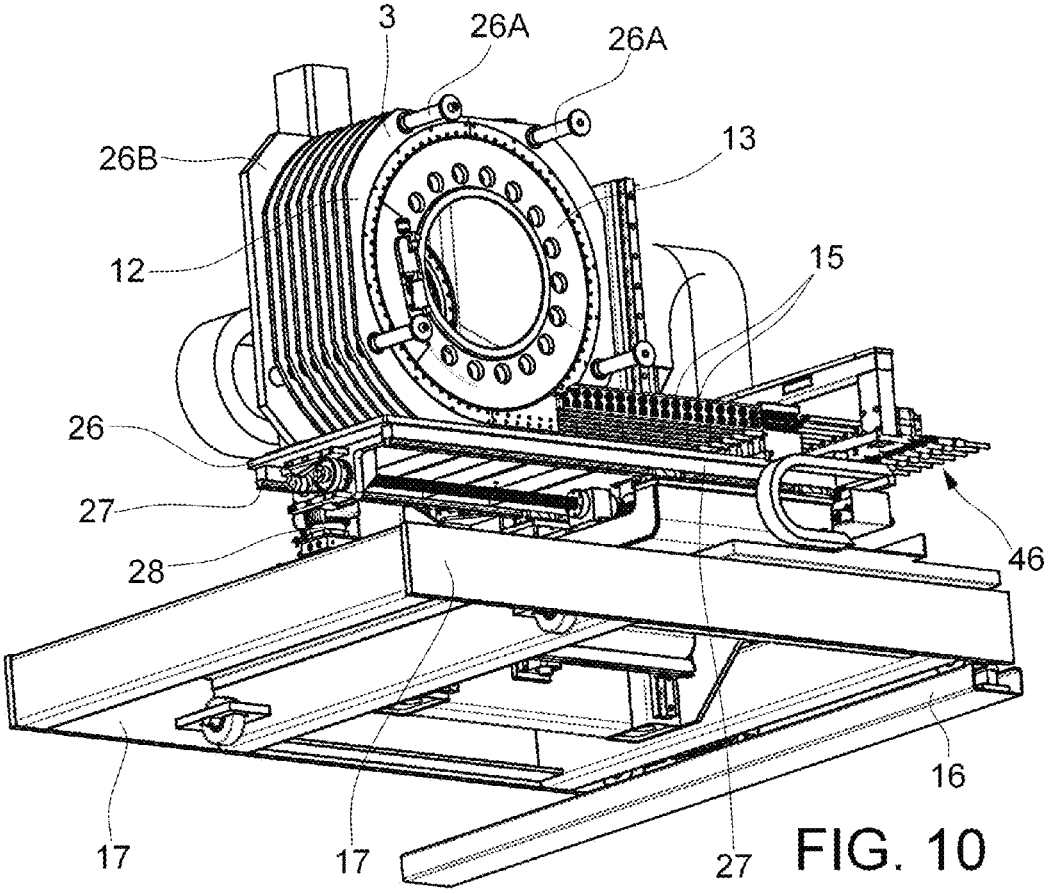
FIG. 10 is a perspective view from below of the machine.

In particular, the slide 26 is actuated by a fourth gearmotor group 28 mounted on the slide 26 itself, see in particular FIG. 10.

The drums 3 are mounted on guide bars 26A mounted on a plate 26B fixedly connected to the slide 26, and on which the first gearmotor group 5 is also fixed.

The drums 3 of the machine are thus mobile according to three directions that are perpendicular to one another, to obtain the maximum operative flexibility, as will become clearer hereafter.

The rotation means 4 of the drums 3 comprise, as stated, a first gearmotor group 5, on the output axis of which a sprocket 29 is fitted.

The rotation means 4 also comprise a tubular shaft 30 along which the drums 3 are fitted.

Figure 7:
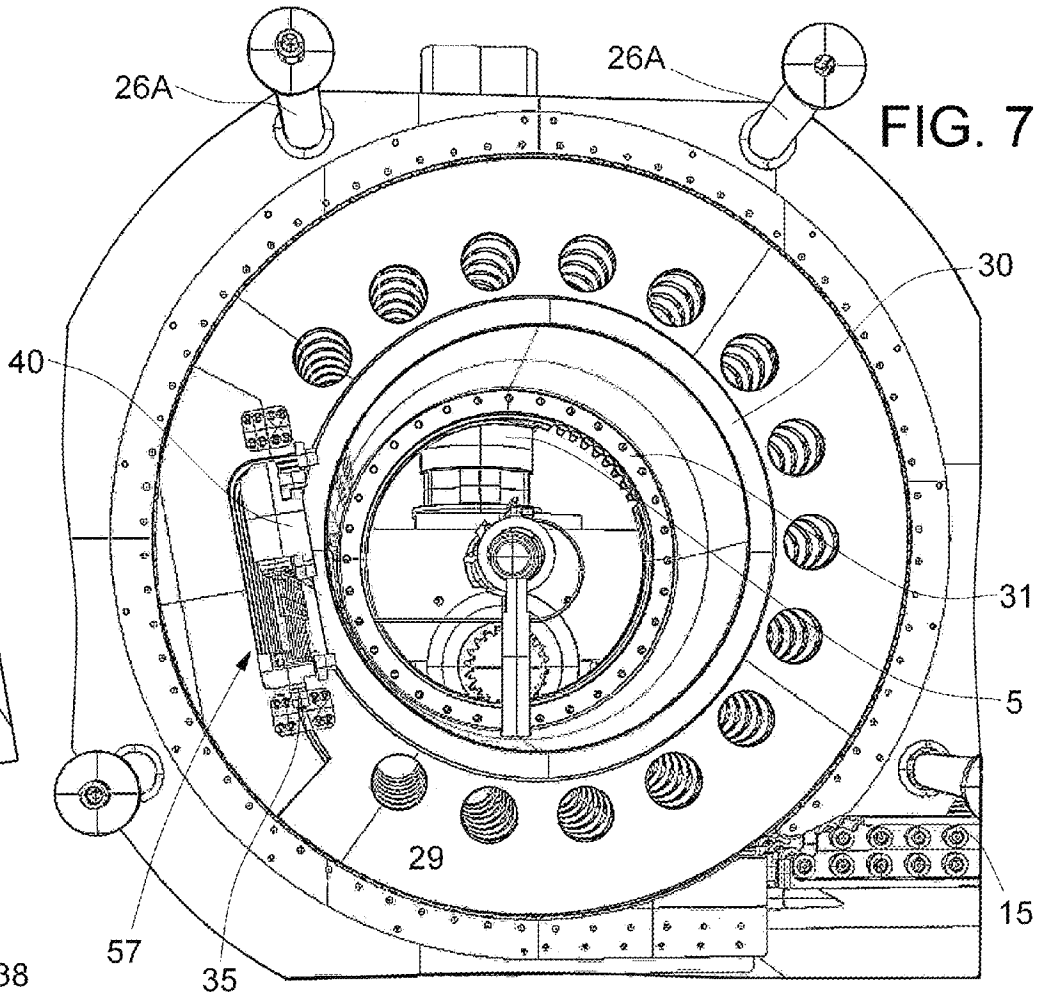
FIG. 7 is a detailed perspective view of a drum of the machine.

The rotation means 4 also comprise a toothed crown 31 associated with the tubular shaft 30, and meshing with the aforementioned sprocket 29, as illustrated in FIG. 7.

Each of the drums 3 comprises a respective seat 32, foreseen in an area adjacent to the tubular shaft 30.

Figures 2, 3:
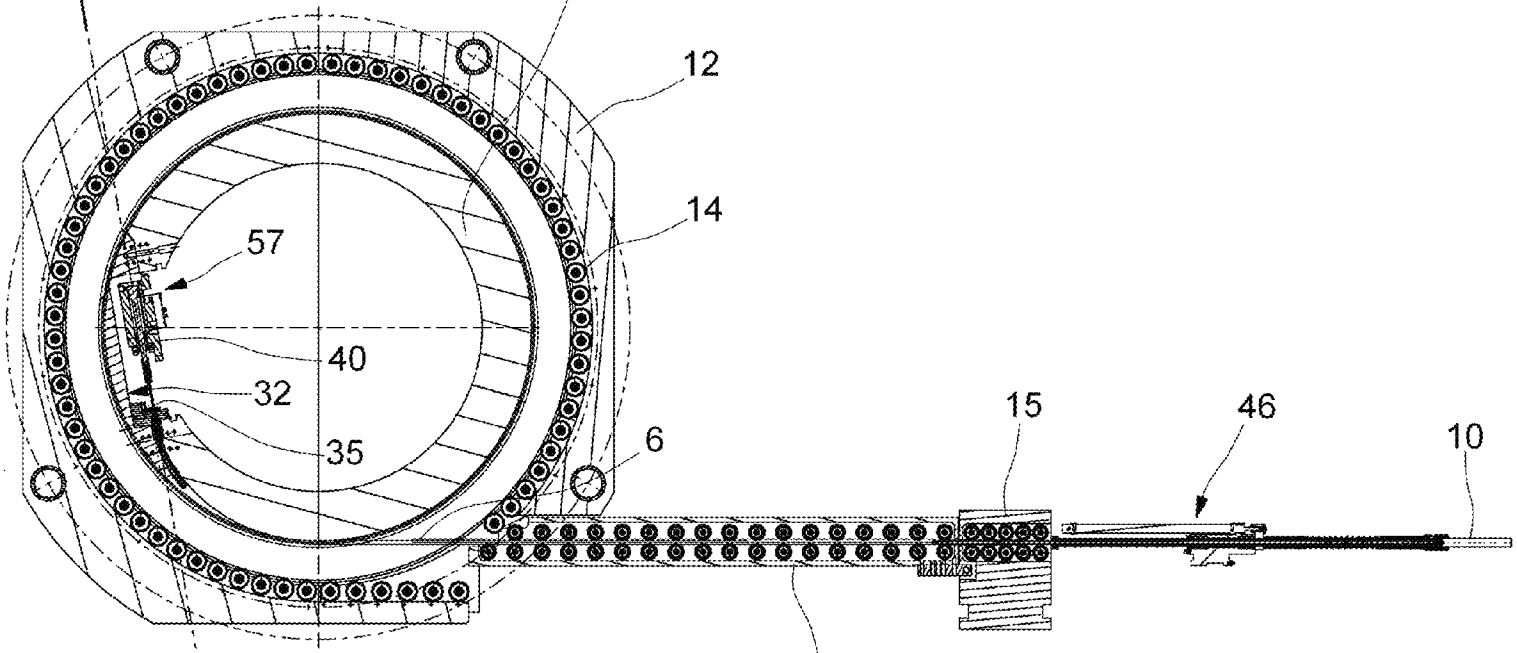
FIG. 2 is a section of the machine at one of the drums.
FIG. 3 is a section of the machine at the plane of FIG. 2.

Each flexible pipe-expanding shaft 6, wound on the mobile inner part 13 of the respective drum 3, as illustrated in FIG. 2, is of the helical spring type.

Figure 4:
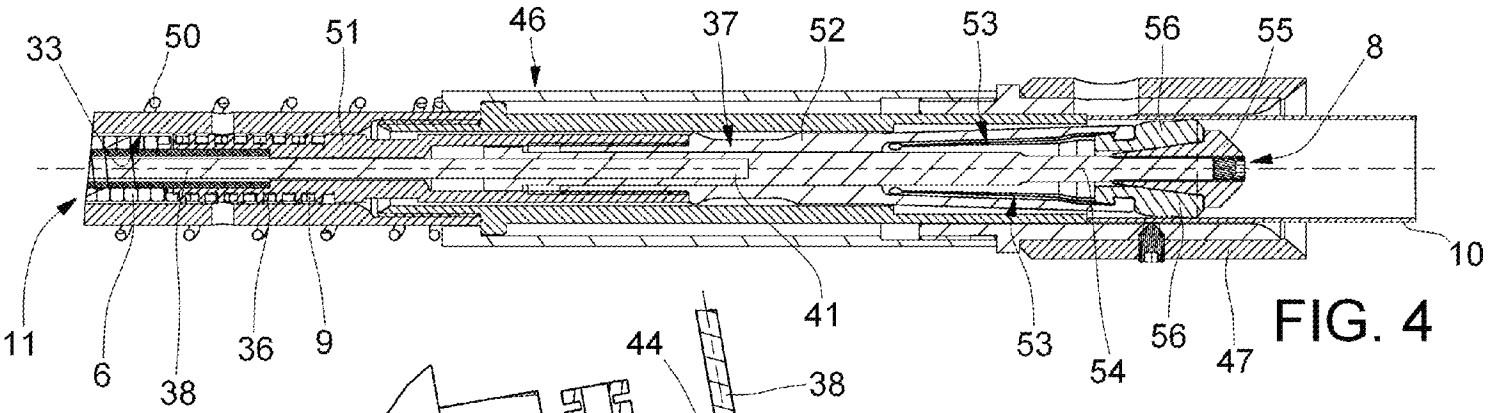
FIG. 4 is a detailed diametral section of the expanding mandrel.
Figure 5:
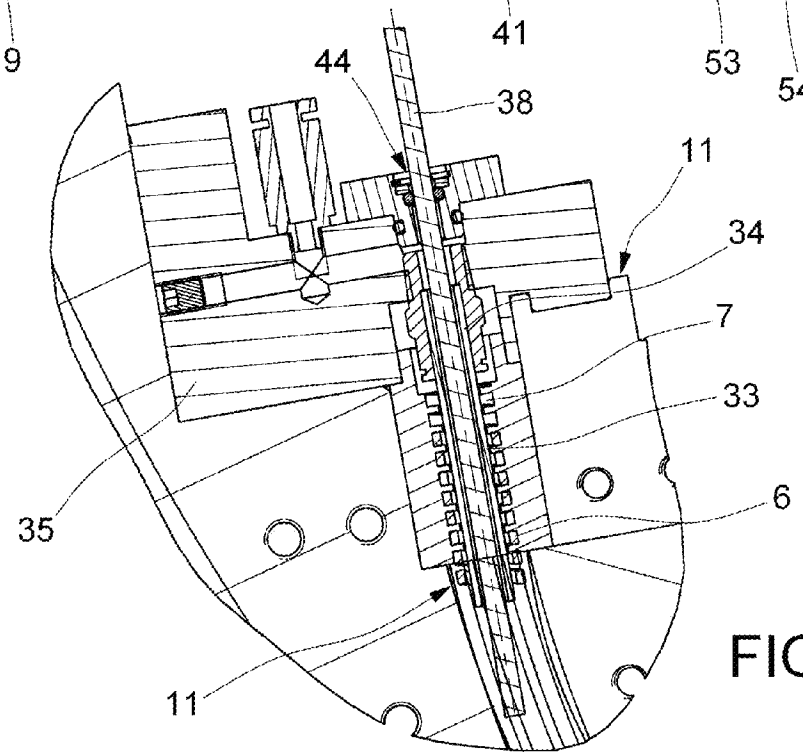
FIG. 5 is a detail of FIG. 2.

For example—see the details of FIGS. 4,5—it can be of the type with a helical spring having a rectangular section, or having another shaped section.

The rectangular section can be preferred to minimise the friction due to the sliding between the juxtaposed coils during the return step of the spring under load.

The automatic lubrication means 11 of the inner surface of the pipes 10 to be expanded comprise, for each of the drums 3, a lubrication duct 33 inserted inside the flexible pipe-expanding shaft 6.

Thanks to this solution, it is possible to send a controlled amount of oil into the pipe expansion area depending on the material used for the pipes.

The lubrication duct 33 is also flexible.

It can be made from any material suitable for the application, without any limitation; for example, it can be made from plastic material.

The lubrication duct 33 comprises a first end portion 34 connected to a fitting 35 foreseen in the respective drum 3, as will become clearer hereafter.

The lubrication duct 33 also comprises a second end portion 36 communicating with an oil meatus 37, foreseen in the expanding mandrel 8.

We will return to the characteristics of the expanding mandrel 8 hereafter.

The flexible pipe-expanding shaft 6 comprises an actuation cable 38 of the expanding mandrel 8, foreseen inside it.

In greater detail, the actuation cable 38 is slotted inside the lubrication duct 33, as illustrated in FIGS. 4,5.

In this way, an extremely compact and functional solution is obtained, exploiting the inner cavity of the lubrication duct 33, which still maintains a free section that is sufficient for the desired flow rate of oil to pass.

The actuation cable 38, obviously also flexible, can be made from any material suitable for the application and for the loads involved.

The actuation cable 38 comprises a first extremity fixed to an actuator 40 housed in the seat 32 foreseen in the respective drum 3, in particular in an end of such a seat 32.

The actuation cable 38 also comprises a second extremity 41, fixed to the expanding mandrel 8.

Figure 6:
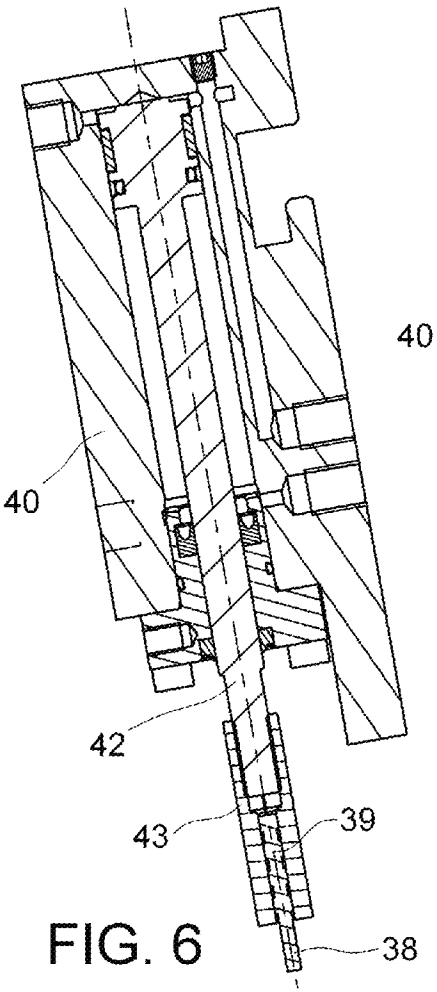
FIG. 6 is another detail of FIG. 2.
Figure 8:
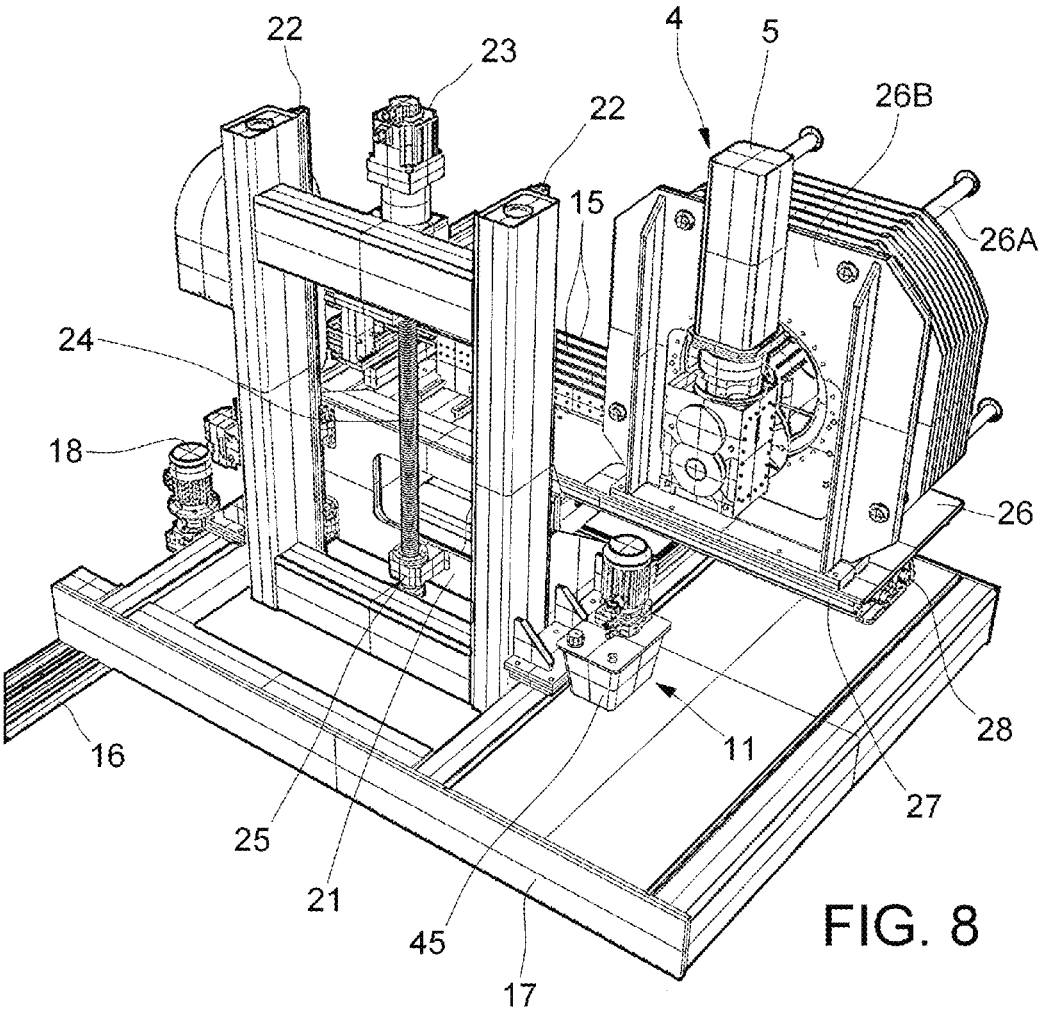
FIG. 8 is a rear perspective view of the machine.
Figure 9:
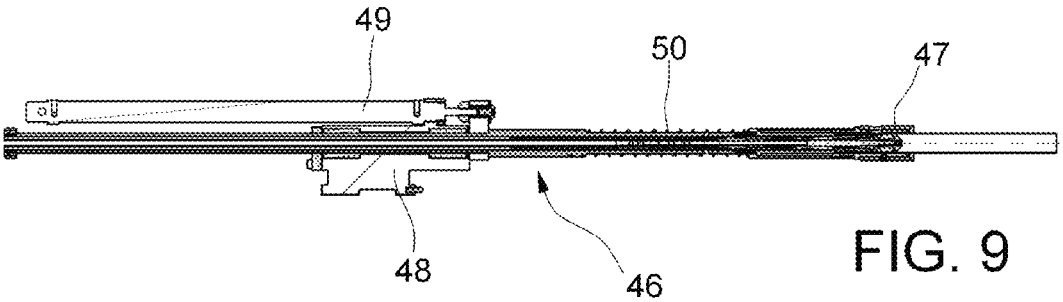
FIG. 9 is another detail of FIG. 2.

The actuator 40 can for example be of the double-acting oil-hydraulic type, and it is mobile from an inactive position to an operative position—illustrated in FIG. 6—in which it exerts a pulling action on the actuation cable 38, to cause the mandrel 8 to expand.

The actuator 40 has, in particular, a stem 42 connected to the first extremity 39 through a clamp 43.

The fitting 35 is also housed in the seat 32, at the other end thereof.

The fitting 35 comprises an opening 44 for the actuation cable 38 to come out from.

The automatic lubrication means 11 also comprise a lubrication control unit 45 connected to the fitting 35.

The lubrication control unit 45—of the per se known type—can be fixed for example to the vertical guides 22 of the carriage 17.

The machine 1 comprises a mobile contrast group, wholly indicated with 46, suitable for abutting at the ends of the pipes 10 to be expanded so as to allow the insertion of the flexible pipe-expanding shafts 6 inside them.

The mobile contrast group 46 is supported in the frame 2—in particular on the slide 26—near to bearing guides 15, and comprises, for each of the pipes to be expanded 10, an abutment head 47 on the end of the pipe 10 itself.

Inside the abutment head 47 the respective flexible pipe-expanding shaft 6 is mobile.

In greater detail, the contrast group 46 comprises a support 48 for an actuation cylinder 49 associated with the abutment head 47.

Between the abutment head 47 and the actuation cylinder 49 a contrast spring 50 is arranged.

The abutment head 47 is thus mobile between two end positions along the aforementioned third horizontal direction.

Such a contrast spring 50 is foreseen since in the pipes to be expanded, subject to shortening due to the expansion of the pipes 10 themselves in the return step of the expanding mandrel 8, it makes it possible to accompany the withdrawal of the pipe 10 itself, exerting a slight pressure that allows the final length of the projection of the expanded pipe at the end of the step to be controlled, having the result that all of the pipes will have the same projection from the metallic frame at the end of expansion of the exchanger.

The expanding mandrel 8, illustrated in the detail of FIG. 4, comprises a first tubular body 51 directly connected to the flexible shaft 6 by screwing its end part onto a spiral seat.

In particular, in FIG. 4 the expanding mandrel 8 is illustrated in expanded configuration, i.e. in expansion configuration of the pipe 10.

The first tubular body 51 has a second tubular body 52 rigidly connected to it, which has the free end engaged by longitudinal notches 53.

The second extremity 41 of the actuation cable 38 is, on the other hand, rigidly connected to a rod 54 carrying a conical collar 55 at the free end.

Between the conical collar 55 and the second tubular body 52 expandable petals 56 are housed and held.

In a per sé known way, the draft exerted by the actuation cable 38 on the rod 54 causes the expansion of the petals 56, so as to carry out the expansion of the pipe 10 by pulling the flexible pipe-expanding shaft 6 due to the winding of the mobile inner part 13 of the respective drum 3.

According to another aspect of the present invention, the machine 1 comprises a selection group, wholly indicated with 57, of the flexible pipe-expanding shafts 6 actually operative.

In other words, the selection group 57 makes it possible to choose which drums 3 to actuate in expansion and which, on the other hand, to keep inactive, in relation to the specific usage requirements.

Such a selection operation is possible with the following conditions.

As a first condition, the number of operative drums 3 must be a submultiple of the number of pipes 10 to be expanded.

The second condition is the possibility, in some steps of the expansion cycle—for example at the start or at the end of the cycle—to make some shafts 6 inactive, inhibiting the action of the conical collar 55.

It is nevertheless possible to repass individual pipes that have already been expanded, without this causing functionality problems of the product.

The machine 1 according to the invention operates in the following way.

Firstly, the slide 26 must be positioned correctly with respect to the position of the pipes 10 to be expanded.

The slide 26, carrying the drums 3, is then moved along the directions X,Y,Z to determine the correct position.

Figure 12:
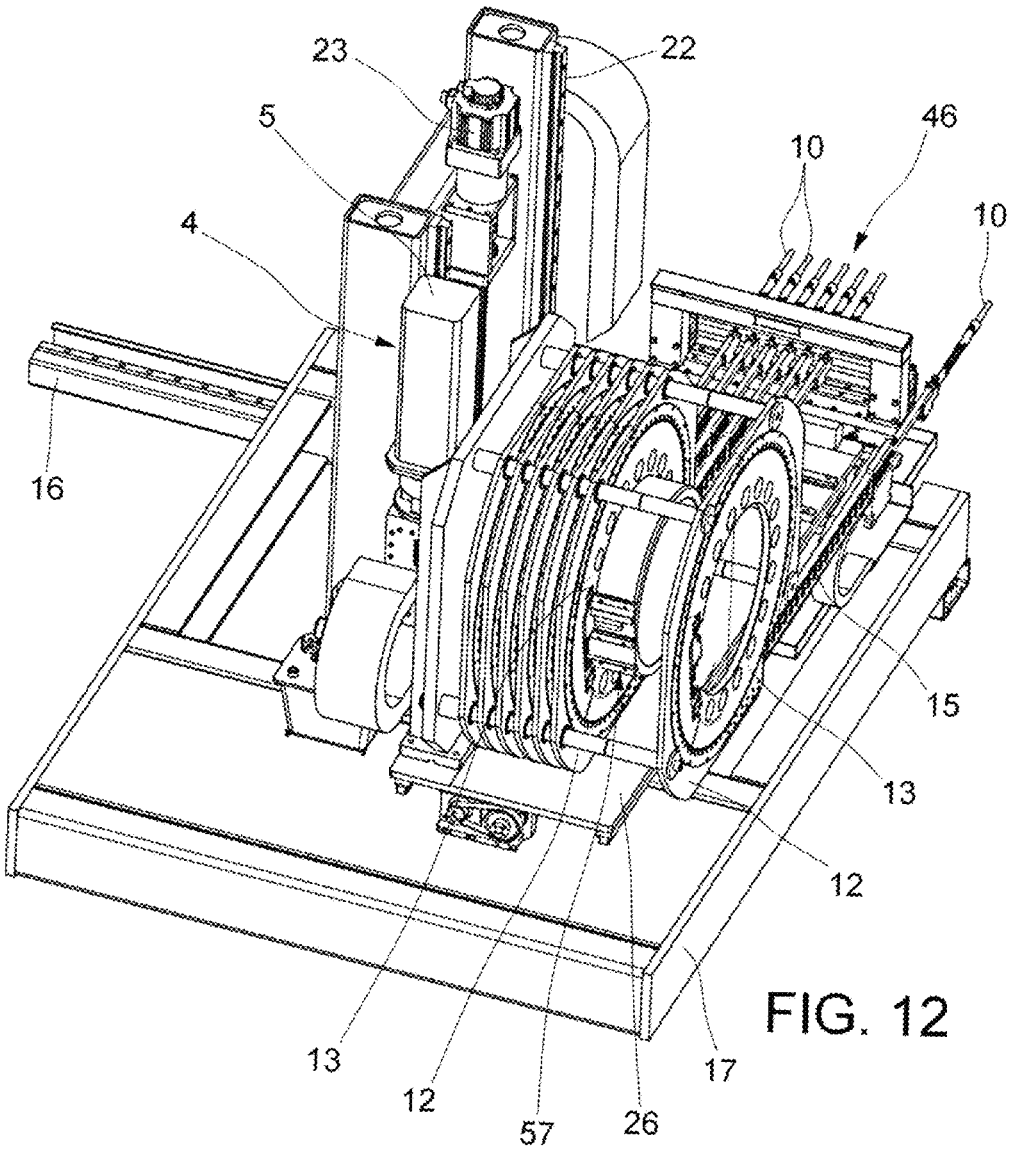
FIG. 12 is a rear perspective view of the machine in a particular operating step.

The drums 3 to be activated are then selected through the selection group 57; the selection is made manually, by deactivating the inoperative drums 3 and excluding them from the rotary movement, as illustrated in FIG. 12.

In particular, the advancing of the slide 26 along the third horizontal direction Y is carried out to bring the contrast group 46 closer to the ends of the pipes 10.

At this point, the expansion of the pipes 10 can begin; here we hypothesise carrying out expansion under draft.

The operative drums 3 are set in rotation so as to unwind the respective flexible shafts 6, which completely slit inside the respective pipes 10.

At this point the actuators 40 are actuated, so as to expand the respective mandrels 8 in the way described earlier.

The drums 3 are now actuated in the direction of rewinding of the flexible shafts 6.

The respective mandrels 8 are then pulled inside the respective pipes 10 so as to expand their diameter.

In this step, the automatic lubrication means 11 are also actuated.

The oil is sent from the station 45 along the ducts 33, and then reaches the meatus 37 foreseen in the mandrels 8 so as to pour inside the pipes 10, so as to effectively lubricate the contact between the petals 56 and the inner surface of the pipes 10 themselves.

The expansion ends when each expanding mandrel 8 reaches the end of the respective pipe 10.

This operation can be carried out again, for example, by translating the slide along the second vertical direction Z to position the flexible shafts 6 at another row of pipes 10 of the same heat exchanger.

Otherwise, it is possible to make the carriage 17 translate to expand the remaining pipes 10 of the same row.

As stated, the machine 1 can also operate to carry out the expansion of the pipes 10 by pushing.

In this case, the expansion is carried out by unwinding the flexible shafts 6 inside the pipes 10, and not by winding them back up.

In order to make this operation possible, the expanding mandrel 8 is replaced by a shaped ogive 58 that is suitably sized to carry out the expansion of the pipes 10, according to concepts that are already known.

Figure 11:
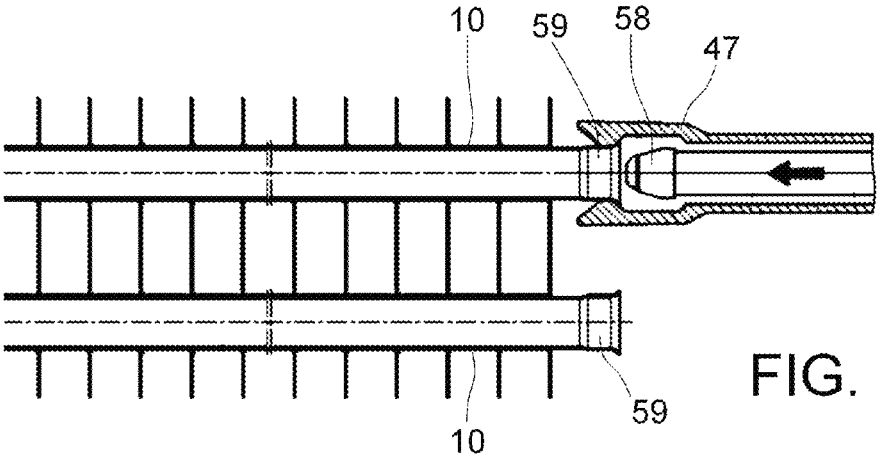
FIG. 11 is a detailed and schematic plan view of the machine in an embodiment in which the pipe expansion is carried out by pushing forward.

The machine in this particular embodiment is illustrated in the detail of FIG. 11.

The shaped ogive 58 is provided with suitable recesses to allow the flow of lubricant from the lubrication duct 33, to the meatus 37 and through such recesses in the area in front of the shaped ogive 58 so as to inject the oil onto the wall of the pipe 10 in front of the movement of the ogive 58 itself and allow an optimal lubrication in the friction area.

In order to counteract the thrust exerted by the ogive 58, the ends of the pipes 10 are widened in advance to form cups 59 with frusto-conical widening that are held by the end support elements that prevent their axial movement during the expansion step under push.

The opposite part of the pipes lacks constraints and can therefore freely contract, following behaviours known in the field.

The invention thus conceived allows important technical advantages to be obtained.

Firstly, the automatic lubrication means 11 allow the mandrel 8—pipe 10 or shaped ogive 58—pipe 10 contact area to be effectively lubricated during the entire expansion operation, with the desired flow rate of oil.

This result is obtained with a constructive solution that is extremely simple, compact and cost-effective also in terms of operation and maintenance.

The controlled lubrication that can be obtained with the solution object of the present invention firstly produces less friction in the expansion step.

Moreover, it allows better control and management of the process, injecting the right amount of lubricant in relation to the materials and to the friction conditions.

A correct lubrication causes less friction that produces less and more uniform shrinkage of the pipes 10 to be expanded.

It is also ensured that it is possible to expand particularly hard materials and large thicknesses.

There is also a lengthening of the lifetime of the expansion mandrels and of the shaped ogives.

In addition the costs for maintaining and replacing the expansion mandrels and the shaped ogives are lower.

Last but not least, there is a reduction in consumption of the main motor with energy and economic benefits.

The general constructive solution of the machine is also extremely simple and cost-effective, since it uses a minimum number of motors and limits the use of mechanical transmissions or other expensive members that are difficult to install and set up.

It has thus been seen how the invention achieves the proposed purposes.

The present invention has been described according to preferred embodiments, but equivalent variants can be devised without departing from the scope of protection offered by the following claims.

The invention claimed is:

1. A tube expanding drum machine, comprising a support frame;

at least one drum rotatably supported in said frame;

means for rotating said drum about its axis;

a flexible pipe-expanding shaft wound on a mobile inner part of said drum and having a first end fixed to said drum;

an expanding mandrel or bullet-shaped body, connected to a second end of said flexible pipe-expanding shaft, suitable for widening the diameter of a pipe by winding or unwinding said flexible pipe-expanding shaft onto or from said drum inside the pipe; and automatic lubrication means of the inner surface of the pipe during the pipe expansion arranged inside said flexible shaft, said automatic lubrication means comprising a flexible lubrication duct inserted inside said flexible pipe-expanding shaft and a fitting arranged in said drum, to which a first end portion of said lubrication duct is connected, said duct comprising a second end portion communicating with a body passage arranged in said expanding mandrel or bullet-shaped body, wherein said flexible pipe-expanding shaft comprises a helical spring, and wherein said flexible pipe-expanding shaft comprises an actuation cable of said expanding mandrel or bullet-shaped body, arranged inside said flexible pipe-expanding shaft.

2. The machine according to claim 1, wherein said automatic lubrication means comprise a lubrication control unit connected to said fitting.

3. The machine according to claim 1, wherein said actuation cable is inserted inside said lubrication duct.

4. The machine according to claim 3, wherein said actuation cable comprises a first extremity fixed to an actuator housed in a seat arranged in said drum, and a second extremity fixed to said expanding mandrel or shaped ogive.

5. The machine according to claim 4, wherein said fitting is housed in said seat and comprises an opening for said actuation cable to come out from.

6. The machine according to claim 1, comprising an abutment head on an end of the pipe, inside which said flexible pipe-expanding shaft is mobile, a support for an actuation cylinder associated with the abutment head, and a contrast spring arranged between the abutment head and the actuation cylinder.

7. The machine according to claim 1, comprising a plurality of said drums, supported coaxially and side-by-side on said frame, for expanding a plurality of pipes arranged side-by-side with parallel axes.

8. The machine according to claim 7, wherein said rotation means comprise a first gearmotor group on an output axis, and a sprocket fitted on said output axis, a tubular shaft along which said drums are fitted, and a toothed crown associated with said tubular shaft and meshing with said sprocket.

9. The machine according to claim 8, wherein said frame comprises a carriage on which said drums are mounted, said carriage being mobile in a first direction which is horizontal and perpendicular to the axis of said pipes.

10. The machine according to claim 9, wherein said frame comprises a bracket structure on which said drums are mounted, said bracket structure being able to slide in a second direction which is vertical along vertical guides arranged in said carriage.

11. The machine according to claim 10, wherein said frame comprises a slide on which said drums are mounted, said slide being able to slide in a third direction which is horizontal along horizontal guides arranged in said bracket structure.

* * * * *